US007233763B2

(12) United States Patent
Shiraishi

(10) Patent No.: US 7,233,763 B2
(45) Date of Patent: Jun. 19, 2007

(54) FIXING APPARATUS WITH A TEMPERATURE LEVELLING MEMBER FOR AN IMAGE FORMING APPARATUS

(75) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/932,105

(22) Filed: Sep. 2, 2004

(65) Prior Publication Data

US 2005/0078990 A1 Apr. 14, 2005

(30) Foreign Application Priority Data

Sep. 2, 2003 (JP) ..... 2003-309658

(51) Int. Cl.
*G03G 15/20* (2006.01)

(52) U.S. Cl. ..... 399/329; 219/216

(58) Field of Classification Search ..... 399/69, 399/329, 334; 219/216
See application file for complete search history.

(56) References Cited

U.S. PATENT DOCUMENTS 6,047,158 A * 4/2000 Morigami et al. ..... 399/328
2002/0118982 A1* 8/2002 Fuma ..... 399/329
2002/0146255 A1* 10/2002 Kishimoto et al. ..... 399/69

FOREIGN PATENT DOCUMENTS

JP 09218602 A * 8/1997
JP 2001-42672 2/2001

* cited by examiner

*Primary Examiner*—Robert Beatty
(74) *Attorney, Agent, or Firm*—Rabin & Berdo, P.C.

(57) ABSTRACT

A fixing apparatus including a belt, a pressuring portion placed facing the belt, and a temperature levelling portion made of heat conducting material placed to be extended in the direction of the width of the belt and to be put on said belt; so as to keep the temperature distribution on the belt uniform in its width direction, without wasting heat, while keeping print quality stable.

20 Claims, 9 Drawing Sheets

FIXING APPARATUS WITH A TEMPERATURE LEVELLING MEMBER FOR AN IMAGE FORMING APPARATUS

BACKGROUND OF THE INVENTION

1. Field of the Invention

The present invention relates to a fixing apparatus used in developing an image.

2. Description of Related Art

In general, a fixing apparatus is used in an image forming apparatus such as electro-photographic printer, copy machine etc. Such a fixing apparatus comprises; at least a heating roller containing heater, a pressuring roller pressed to the heating roller and rotated by the heating roller, a fixing belt put on the heating roller etc. Then, said heating roller, pressuring roller and fixing belt comprise a fixing nip. And, print media holding unset toner image, is passed through this fixing nip. Thereby, the toner image is fixed to the print media. This is a fixing apparatus using a method of heating roller.

FIG. 2 is a side view showing configuration of a conventional fixing apparatus.

In FIG. 2, 111 indicates a first heating roller. 112 indicates a fixing belt, 113 indicates a second heating roller, and 114 indicates a pressuring roller. Here, said first heating roller 111 and second heating roller 113 are respectively provided with halogen lamps as internal heating means. Thereby, said fixing belt is heated. Moreover, said pressuring roller 114 is placed confronting with said second heating roller 113. And, it is pressed to the second heating roller 113 with the fixing belt therebetween. Thereby, they comprise a fixing nip. And, print media 115 holding unset toner image, passes through the fixing nip comprising said second heating roller 113, fixing belt 112 and pressuring roller 114. Thereby, the toner image is fixed to the print media 115.

In above conventional fixing apparatus, a temperature detecting sensor not shown in the drawings is provided at a central portion of the fixing belt 112 in direction of its width. Thereby, temperature control is performed in order to settle temperature of said fixing belt 112 to a fixed value. However, when print media 115 with narrow width continuously pass through the fixing nip; both end portions in direction of width of fixing belt 112, temperature rises; because print media 115 do not pass at both end portions of fixing belt 112, where heat is not taken away by print media 115. Therefore, there can be case that inconvenience such as offset caused by hot end portions, gross blotches etc. occurs.

Accordingly, in order to cope with temperature rise in the fixing belt 112, cooling devices such as cooling fans, Peltier elements, etc. are used. The fixing belt 112 is therefore cooled when the temperature of fixing belt 112 rises. This kind of fixing apparatus is disclosed in, for example, JP 2001-42672.

However, in said conventional fixing apparatus, heat in the fixing belt is taken away by radiating it in the air. Therefore, availability of heat energy in the fixing apparatus decreases.

SUMMARY OF THE INVENTION

The present invention intends to provide a fixing apparatus solving problems of conventional fixing apparatus mentioned above, being able to keep stable print quality with keeping uniformity of temperature in the fixing belt and without wasting heat energy radiating in the air, by distributing heat equally between left, right and center of the fixing belt.

According to the present invention, there is provided a fixing apparatus comprising: a belt, a pressuring portion placed confronting with said belt, and a temperature levelling portion made of heat conducting material placed to be prolonged in direction of width of said belt and to be put on said belt.

DESCRIPTION OF THE PREFERRED EMBODIMENTS

Figure 1A:
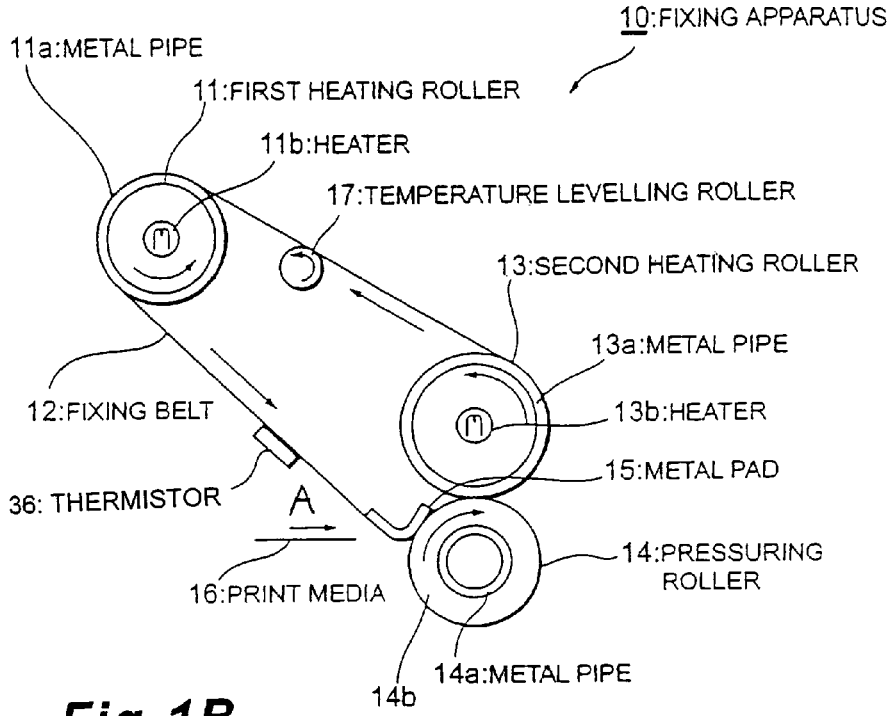
FIGS. 1A and 1B are side and slanted views showing a configuration of a fixing apparatus of Embodiment 1 according to the present invention.

Hereafter, Embodiments of present invention is described referring to the drawings.

Embodiment 1

<Configuration>

Figure 1B:
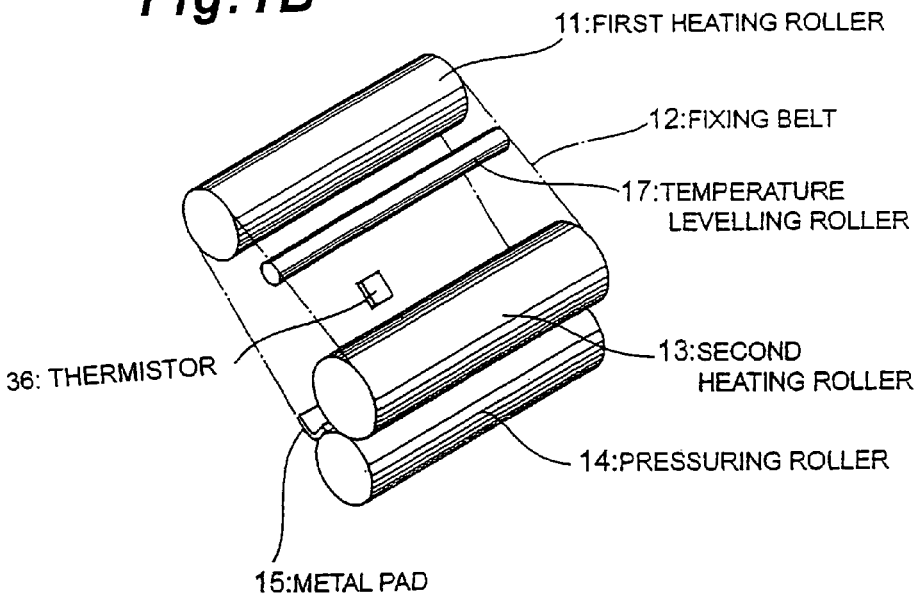
Figure 2:
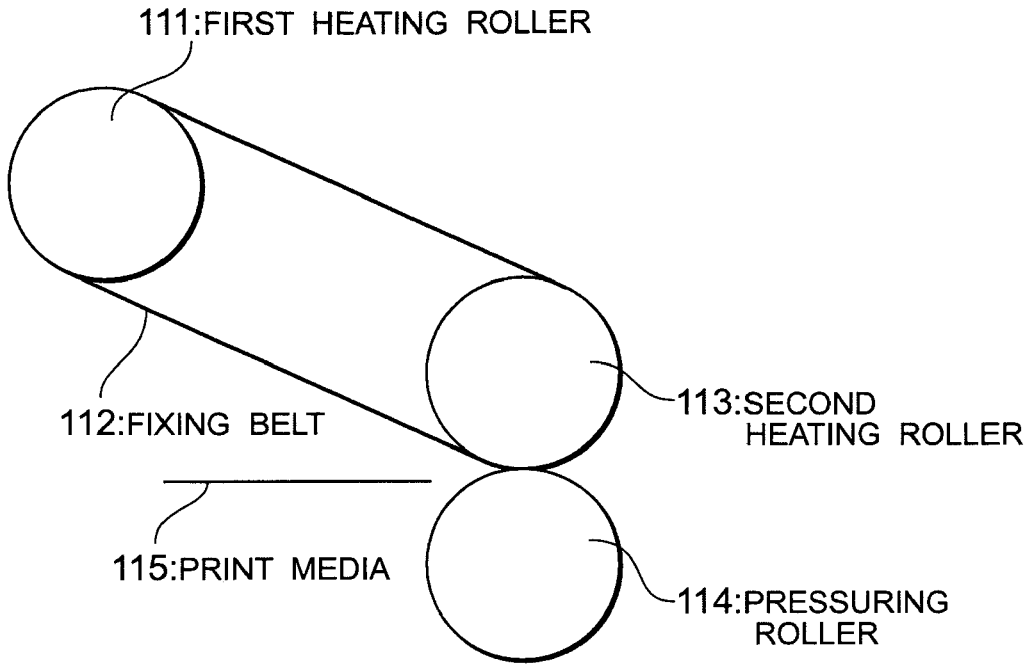
Fig.2 PRIOR ART
FIG. 2 is a side view showing configuration of a conventional fixing apparatus.

FIGS. 1A and 1B show a configuration of a fixing apparatus of Embodiment 1 according to the present invention. FIG. 1A is a side view. FIG. 1B is a slanted view.

In FIGS. 1A and 1B, what is shown is a fixing apparatus 10 for an image forming apparatus such a an electro-photographic printer, copy machine etc. The fixing apparatus 10 pass as print media 16 such as a print sheet envelope etc., which holds an unset toner image. This print media is passed through a nip region of the fixing apparatus 10. Thereby, the toner image is fixed to the print media 16 by melting toner. Incidentally, said image forming apparatus has other devices not shown in the drawings such as a sheet tray containing print media 16, a conveying device including a transferring belt conveying print media 16, an image forming unit forming toner image on an image holder comprising a photo-sensitive drum based on image forming data and transcribing the toner image to the print media, etc. On this occasion, the print media 16 fed from the sheet tray, are conveyed by the conveying device, so as to be sent to the image forming unit and, in a transcribing section of the image forming unit, toner image is transcribed. After this, the print media 16 are sent to the fixing apparatus 10, so as to fix the toner image.

And, as heating means, a first heating roller 11 and a second heating roller 13 are provided. Here, said first heating roller 11 and second heating roller 13 are placed parallel with each other. And, they are installed at each supporting member not shown in the drawings, enabling to rotate. Moreover, around said first heating roller 11 and second heating roller 13, a fixing belt 12 as an endless belt is put on. Further, a pressuring roller 14 as a pressuring means is provided confronting with said second heating roller 13. And, it is installed at a supporting member not shown in the drawings, enabling to rotate. Moreover, it is pressed to said second heating roller 13 with said fixing belt 12 intervening therebetween. Thereby, said fixing belt 12, second heating roller 13 and pressuring roller 14 comprise a fixing nip.

And, said first heating roller 11 and second heating roller 13 comprise metal pipes 11*a*, 13*a* such as aluminum, iron etc. And, they have heaters 11*b*, 13*b* respectively comprising halogen lamp, electric heater etc. installed inside of metal pipes 11*a*, 13*a*. Thereby, said fixing belt 12 is heated up to a prescribed temperature. Incidentally, either of said first heating roller 11 or second heating roller 13 may not have either of heaters 11*b*, 13*b*.

Moreover, said fixing belt 12 can comprise any material as long as the material is good for endless belts. For example, it can comprise a heat-resisting resin such as polymido, etc. Alternatively, it can comprise an elastic layer comprising silicone rubber, fluoric resin etc. on a base of a body comprising metal such as Ni (nickel) or SUS (stainless).

Further, said pressuring roller 14 comprises a metal pipe 14*a* such as aluminum, iron etc. And, it is provided with an elastic layer of rubber etc. on surface of said metal pipe 14*a*. Incidentally, said pressuring roller 14 is preferably pressed to said second heating roller 13 by pressuring means provided with enforcing means such as spring member etc. not shown in the drawings. Moreover, said pressuring roller 14 can have a heater comprising halogen lamp, electric heater etc. installed inside of metal pipe 14*a*. In this occasion, said pressuring roller 14 serves as both heating means and pressuring means.

In Embodiment 1, described is an occasion when said first heating roller 11 and second heating roller 13 are heating means. However, the present invention is not limited to this. Said pressuring roller 14 can be a heating means. Further, heating means can be either of said first heating roller 11 or second heating roller 13, as mentioned before. Or, combination of first heating roller 11 and pressuring roller 14 or combination of second heating roller 13 and pressuring roller 14 can be used as heating means. However, heating means is enough if it comprises either of first heating roller 11, second heating roller 13 or pressuring roller 14.

Further, in the vicinity of said second heating roller 13 and pressuring roller 14, there is a metal pad 15 put on inner surface of said fixing belt 12 and extended in the direction of the width of said fixing belt. The fixing nip formed between said belt 12 and pressure roller 14, is broadened by the metal pad 15. The print media 16 is conveyed by a conveying device not shown in the drawings, in a direction designated by arrow A. Then, the print media 16 passes through the fixing nip formed by second heating roller 13, fixing belt 12, metal pad 15 and pressuring roller 14. Thereby, a toner image is heated and pressed, melted and fixed to the print media 16.

Moreover, a temperature levelling roller 17 as heat levelling means, is installed able to rotate at a supporting member not shown in the drawings. And, surface of the temperature levelling roller 17 is kept in contact with the inner surface of the fixing belt across its width. Here, said temperature levelling roller 17 levels temperature in direction of width of the fixing belt 12. Then, irregular distribution of temperature in direction of width of the fixing belt 12, is relieved. For this purpose, said temperature levelling roller 17 comprises a member having good heat conductivity, for example, metal roller, heat pipe etc. Incidentally, said temperature levelling roller 17 can comprise whichever kind of member as far as it has good heat conductivity in its axial direction. It can comprise a metal plate instead of roller. Moreover, said temperature levelling roller 17 is able to rotate in rotary direction designated with an arrow as shown in the drawings. Here, said temperature levelling roller 17 is rotated with a peripheral velocity same as a velocity of the belt 12. However, said temperature levelling roller 17 can be rotated with another peripheral velocity different from the velocity of belt 12.

Subsequently, described is operation of said temperature levelling roller 17.

Figure 3:
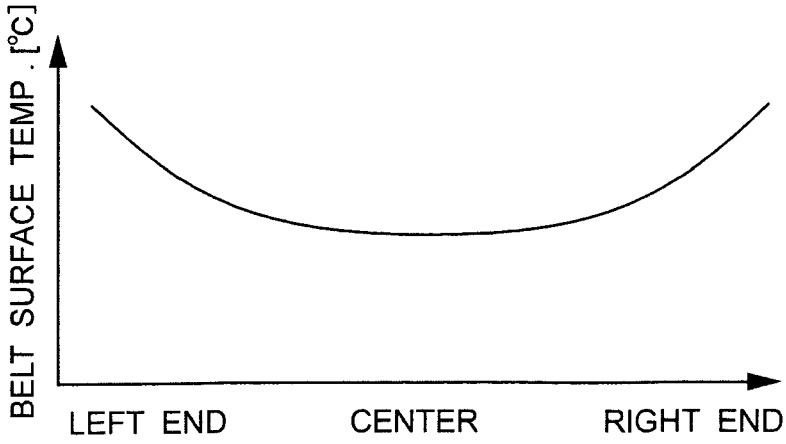
FIG. 3 is a graph showing temperature distribution of fixing belt in its width direction when narrow print media passed in case that any temperature levelling roller is not provided.
Figure 4:
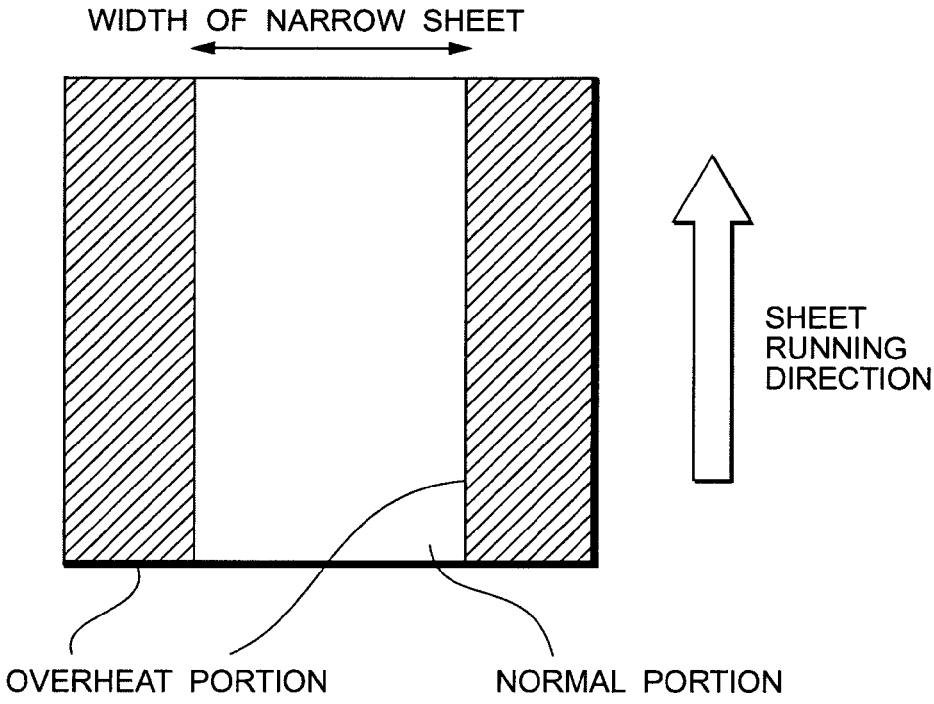
FIG. 4 is a plan view showing quantity of print when printing is performed to wide print media after narrow print media passed in case that any temperature levelling roller is not provided.
Figure 5:
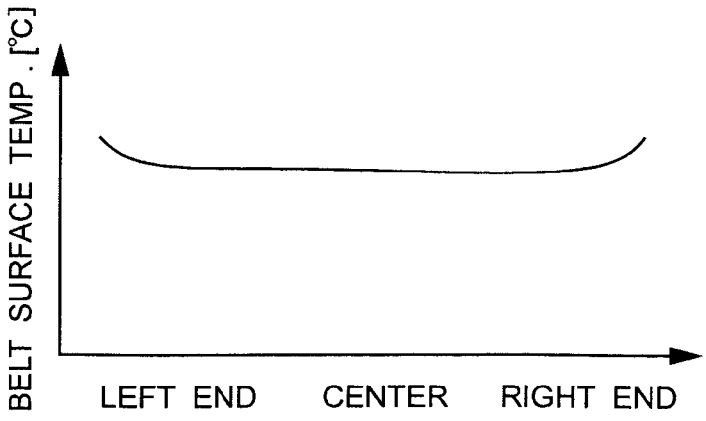
FIG. 5 is a graph showing temperature distribution of fixing belt in its width direction when narrow print media passed in case that temperature levelling roller is provided.

FIG. 3 is a graph showing temperature distribution of fixing belt in its width direction when narrow print media passed in case that any temperature levelling roller is not provided; FIG. 4 is a plan view showing quantity of print when printing is performed to wide print media after narrow print media passed in case that any temperature levelling roller is not provided; FIG. 5 is a graph showing temperature distribution of fixing belt in its width direction when narrow print media passed in case that temperature levelling roller is provided.

In case that print media 16 has narrow width, such as print sheet of A5 size, envelope etc. print media 16 passes through central portion in direction of fixing belt 12 not through both end portions; when it passes through the fixing nip. In this case, at a portion where said print media 16 passed, heat of fixing belt 12 is absorbed in print media 16. Therefore, in case that temperature levelling roller 17 is not provided, as shown in FIG. 3, surface temperature of central portion of fixing belt 12 decreases much.

On the other hand, at both end portions where print media 16 does not pass, the surface temperature is higher than the central portion. The reason is that both end portions of fixing belt 12 is heated by first heating roller 11 and second heating roller 13 as well as central portion and that heat at both end portions remains in the fixing belt without absorbing in the fixing belt 12, because print media 16 does not pass.

In such state, if printing to narrow print media 16 is performed repeatedly in image forming apparatus, then temperature at both end portions of the fixing belt 12 still increases. Therefore, difference of temperature between both end portions and central portion, increases very much.

And, in image forming apparatus, after printing to print media 16 with narrow width is performed, printing to print media 16 with wide width such as print sheet of A4 size, letter sheet etc. is performed. Then, print media 16 with wide width passes through the fixing nip in a state that temperature difference between both end portions and central portion of the fixing belt 12 is large. In this case, as shown in FIG. 4, both end portions of print media with wide width are heated up to high temperature by passing through both end portions of fixing belt 12. Therefore, print quantity changes at boundary where edge of print media 16 with narrow width passed until last time. And, inconvenience such as hot offset, gross blotches etc. occurs at both end portions of print media 16 heated to high temperature.

Therefore, by providing temperature levelling roller 17 to be in contact with the fixing belt 12 at inside of fixing belt 12, heat is transmitted from high temperature portion, that is, both end portions of fixing belt 12 to low temperature portion, that is, central portion through temperature levelling roller 17. Therefore, even after print media 16 with narrow width passed through the fixing nip, as shown in FIG. 5, temperature distribution in direction of width of fixing belt 12 is levelled.

<Operation>

Subsequently, described is operation of the fixing apparatus having configuration mentioned above.

Figure 6:
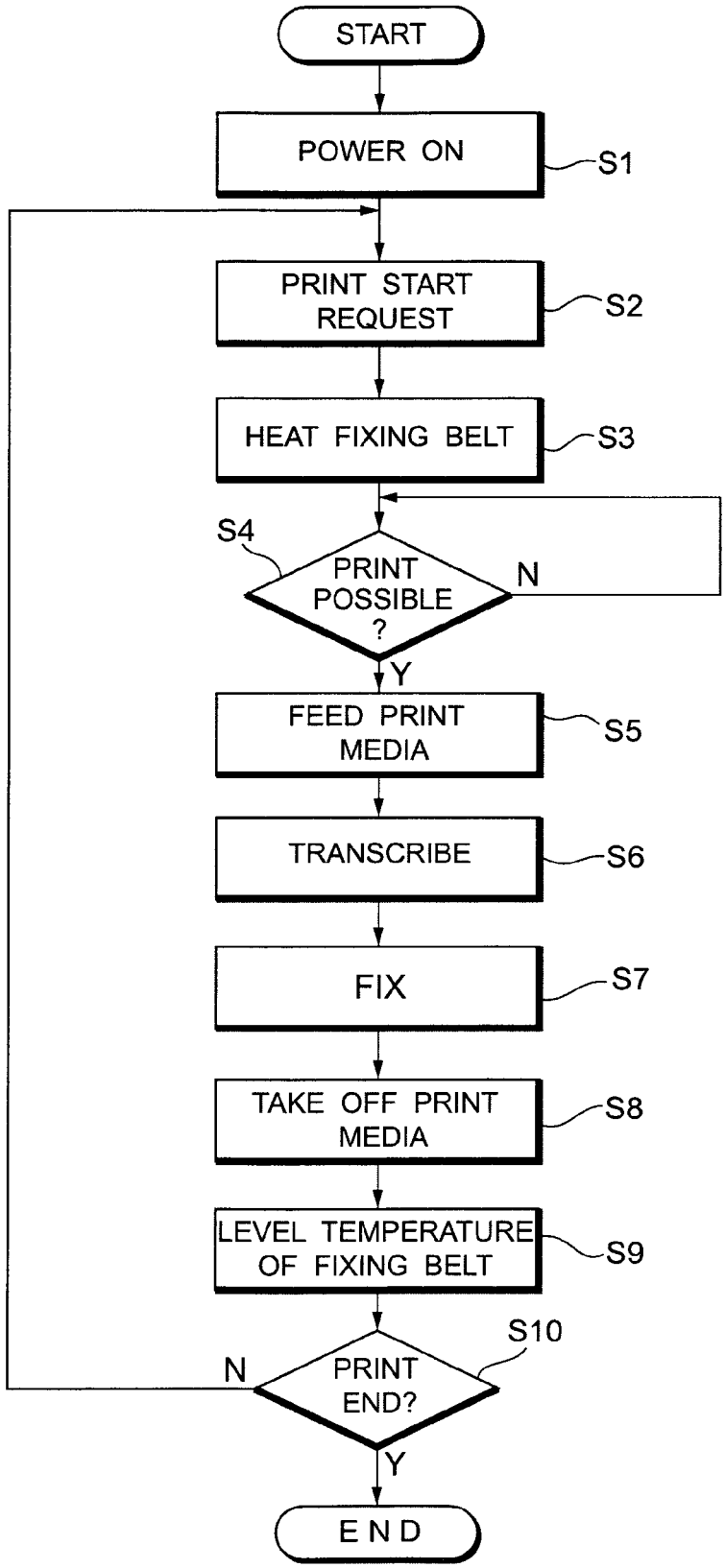
FIG. 6 is a flow chart showing operation of a fixing apparatus of Embodiment 1 according to present invention.

FIG. 6 is a flow chart showing operation of a fixing apparatus of Embodiment 1 according to present invention.

At first, power supply switch of the image forming apparatus is turned on. Succeedingly, print start request for starting printing to print media 16 is performed. Then, electric current flows into each heater of said first heating roller 11 and second heating roller 13. And, the fixing belt 12 is heated by said first heating roller 11 and second heating roller 13, up to temperature range able to start printing. Here, this temperature range is set beforehand. And, temperature of fixing belt is kept in this temperature range under on-off control for heater according to result of detecting temperature with a thermistor.

Succeedingly, when said fixing belt 12 get in the temperature range able to start printing, print media 16 is fed by a hopping mechanism not shown in the drawings from a sheet tray. And, when the printing media 16 is fed, toner image is transcribed to the print media 16 in a transcribing section of image forming unit.

Subsequently, the print media 16 transcribed with toner image, is sent to the fixing nip formed with the second heating roller 13, fixing belt 12, metal pad 15 and pressuring roller 14. Then, it is conveyed with its both end faces nipped by the rotating fixing belt 12 and pressuring roller 14 respectively. And, heat energy is given to toner image and print media 16 at said fixing nip. Then, the toner image is melted and fixed to print media 16. And, when fixing of the toner image to the print media 16 is finished, said print media 16 is peeled off from the fixing belt 12. And, it is ejected from the image forming apparatus by an ejecting roller not shown in the drawings.

Subsequently, portion of fixing belt 12 peeled off with print media 16, is conveyed to temperature levelling roller 17 as a levelling means. And, irregularity of temperature of fixing belt occurring when toner image is fixed to print media 16, is relieved by the temperature levelling roller 17. That is, temperature distribution in direction of width of fixing belt is levelled, because heat in the portion of fixing belt 12 with high temperature is transmitted to a portion with low temperature; in the occasion when the portion with low temperature occurred at a portion where print media 16 passed, while the portion with high temperature occurred at a portion where print media 16 did not pass.

And, when irregularity of temperature is relieved, the fixing belt 12 is heated by the first heating roller 11. In this occasion, the fixing belt 12 is heated without irregularity of temperature in direction of its width, by using the first heating roller 11. Thereby, the portion of fixing belt 12 is available for succeeding print media 16. Incidentally, in case that printing is performed to succeeding print media 16, operation performed after printing start request mentioned above, is performed repeatedly.

Subsequently referred to is the flow chart.

At step S1, power switch is turned on.

At step S2, print start request is received.

At step S3, fixing belt 12 is heated by heating roller 12.

At step S4, it is judged whether temperature is enough for starting print or not. In case that print start is possible with present temperature, the process proceeds to step S5. Otherwise, the process waits.

At step S5, print media 16 is fed.

At step S6, toner image is transcribed to print media 16.

At step S7, toner image is fixed to print media 16.

At step S8, print media 16 is peeled off from fixing belt 12.

At step S9, irregularity of temperature in fixing belt 12 is relieved by temperature levelling roller 17.

At step S10, whether printing ends or not, is judged. In case that printing ends, the whole process ends. Otherwise, the process proceeds to step S2.

<Effects>

As mentioned above, in Embodiment 1, the temperature levelling roller 17 is provided so as to be in contact with the fixing belt 12 at inside face of the fixing belt 12. Thereby, distribution of temperature in width of fixing belt 12 is levelled, after fixing of toner image to the print media 16 is completed. And, irregularity of temperature in fixing belt 12 is relieved. Therefore; even in case that printing to print media 16 with different width, is continuously requested; a stable print quality can be kept.

Embodiment 2

<Configuration>

Subsequently described is Embodiment 2 of present invention. Incidentally, elements in Embodiment 2, which have configuration same as corresponding elements in Embodiment 1, is designated with the same symbols. Thereby, same description duplicating is omitted. Moreover, same operation and same effect is omitted.

Figure 7:
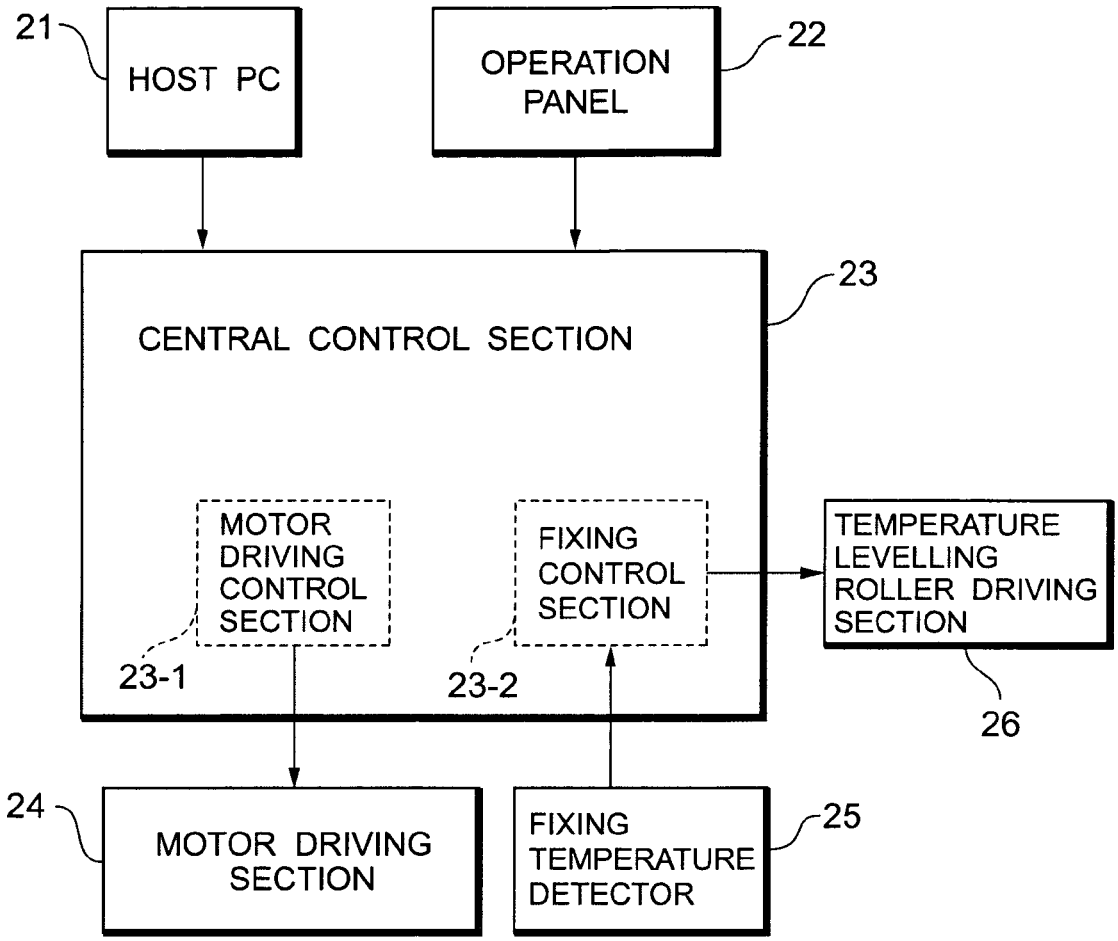
FIG. 7 is a block diagram showing configuration of control device of a fixing apparatus of Embodiment 2 according to present invention.

FIG. 7 is a block diagram showing configuration of control device of a fixing apparatus of Embodiment 2 according to present invention; FIG. 8 is a sketch diagram showing configuration of temperature levelling roller driving section of a fixing apparatus of Embodiment 2 according to present invention.

Meanwhile, in Embodiment 1 mentioned above, the temperature levelling roller 17 is in contact with the fixing belt 12 at all times. Therefore, part of heat energy held in the fixing belt 12 is released into the air through the temperature levelling roller 17 that has good heat conductivity. Then, efficiency of energy of fixing apparatus 10 decreases. Therefore, in Embodiment 2, the temperature levelling roller 17 is comprised so that it is able to separate from the fixing belt 12.

As shown in FIG. 7, an image forming apparatus has a central control section 23 as a control device. The central control section 23 has a calculating means of CPU, MPU etc. memorizing means of magnetic disc, semiconductor disc etc. Therefore, the central control section 23 is a kind of computer, which performs overall control of operation of said image forming apparatus. Incidentally, said central control section 23 has a motor driving control section 23-1 for controlling operation of motor which drives conveying device, image forming unit, fixing device 10 etc. and a fixing control section 23-2 for controlling operation of fixing device 10. Incidentally, said motor driving control section 23-1 decides on-off timing of said motor. Said motor driving control section 23-1 and fixing control section 23-2 are preferably plural control systems installed in the central control section 23. However, they can be made up of other hardware different from the central control section 23.

Moreover, a host computer 21 is a host device of image forming apparatus. It is connected with the central control section 23 able to communicate. It sends print job, media data as data about print media 16 etc. to the central control section 23. Here, said host computer 21 has a calculating means of CPU, MPU etc. memorizing means of magnetic disc, semiconductor memory etc. input means of keyboard, mouse etc. presenting means of CRT, liquid crystal display etc. communication interface etc. And, the host computer 21 is preferably some kind of computer, for example, personal computer, server, work station etc. However, it can be any kind of computer.

And, an operation panel 22 is used by an operator to operate the image forming apparatus. This operation panel 22 is provided with casing of the image forming apparatus. Said operation panel 22 has input means of press button, keyboard etc. presenting means of CRT, liquid crystal display etc. And, it is connected with said central control section 23 to be able to communicate. Incidentally, said operation panel 22 preferably comprises touch panel having both functions of input means and presenting means. And, an operator can perform setting of print media 16, that is, he or she can change setting of print media 16, by operation with using said operation panel 22.

Moreover, a motor driving section 24 is a section for driving motors to drive the conveying device, image-forming unit, fixing apparatus 10 etc. Also, it supplies electric current for driving each motor based on a control signal from said motor driving control section 23-1. That is, on-off control of said motor is performed by receiving a control signal from said motor driving control section 23-1. Further, a fixing temperature detector 25 comprises a temperature detecting sensor comprising a thermistor etc. shown in FIGS. 1A and 1B, which is placed at a central portion in a width direction of fixing belt 12 outside of fixing belt 12. And, the fixing temperature detector 25 transmits a signal indicating the detected temperature of the fixing belt 12 to the fixing control section 23-2.

Figure 8A:
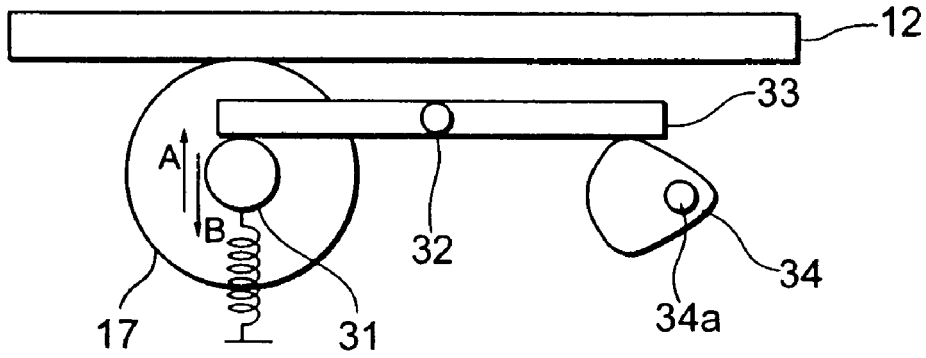
FIGS. 8A and 8B show a configuration of temperature levelling roller driving section of a fixing apparatus of Embodiment 2 according to the present invention.
Figure 8B:
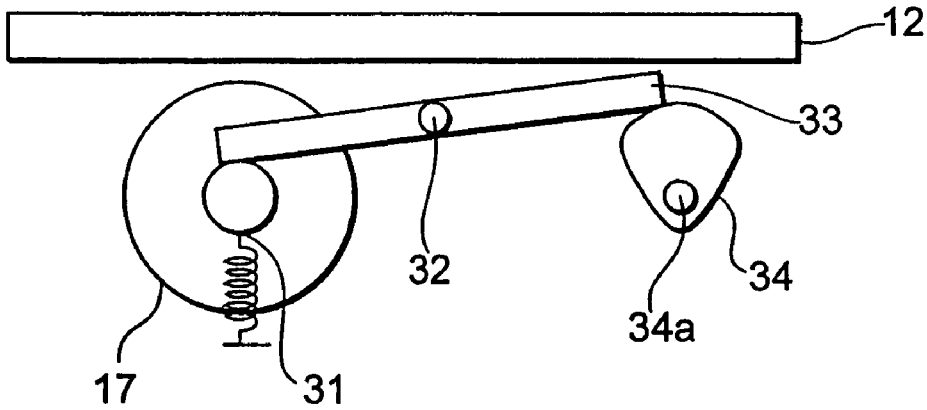

In Embodiment 2, unlike Embodiment 1, the temperature levelling roller 17 is mounted on a frame not shown in the drawings, which is able to move in a direction perpendicular to the direction that the fixing belt 12 proceeds. Therefore, the temperature levelling roller 17 is, as shown in FIGS. 8A and 8B, able to move either upward or downward, and it is pressed upward by an enforcing member, as shown in FIG. 8A.

Moreover, a temperature levelling roller driving section 26 has a mechanism for moving the temperature levelling roller 17 from the fixing belt 12 and to the fixing belt 12. The mechanism has, as shown in FIG. 8A, a swaying rod 33 swaying around a fulcrum 32 and touching with one of its ends at an axis 31 which supports the temperature levelling roller 17, and a driving cam 34 touching another end of the swaying rod 33 in order to drive the swaying rod 333. Said temperature roller driving section 26, with receiving control signal from the fixing control section 23-2, operates a driving source not shown in the drawings, so as to rotate said driving cam 34 to a prescribed position as shown in FIG. 8B. Here, the driving source comprises a motor etc. The output axis of the motor is engaged with a supporting axis 34*a* of the driving cam 34, enabling to rotate the driving cam 34 with operating the motor. Thereby, as shown in FIG. 8B, the swaying rod 33 sways so as to move axis 31 downward. Therefore, the temperature levelling roller 17 separates from the fixing belt 12.

Incidentally, the mechanism for moving the temperature levelling roller 17 from the fixing belt and to the fixing belt, can comprise any other configuration. It can have any member other than the swaying rod 33 or driving cam 34. Moreover, an example of moving the temperature levelling roller 17 is described. However, instead, the fixing belt 12 can be moved, as far as the temperature levelling roller 17 and the fixing belt 12 separate or contact with each other.

<Operation>

Subsequently described is operation of the fixing apparatus 10 of Embodiment 2.

Figure 9:
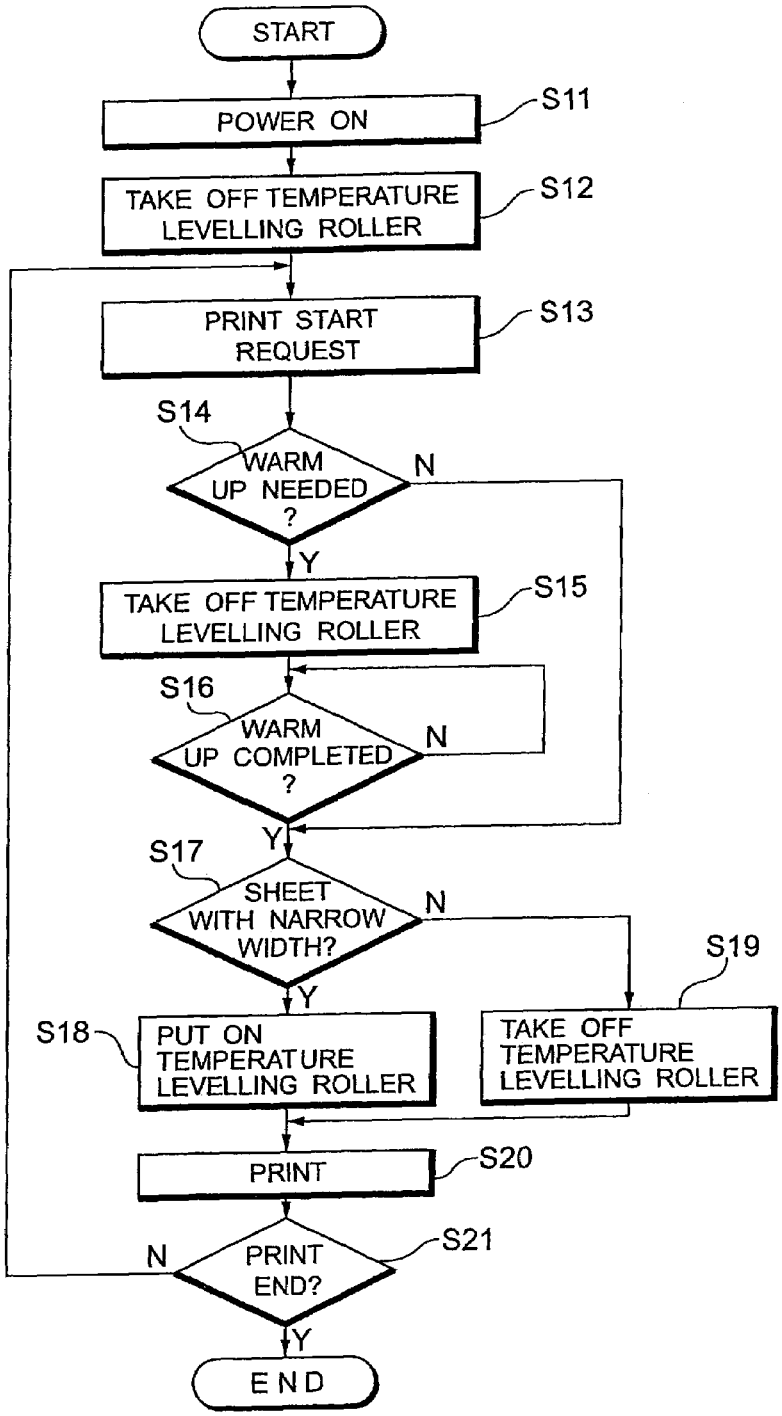
FIG. 9 is a flow chart showing operation of a fixing apparatus of Embodiment 2 according to present invention.

FIG. 9 is a flow chart showing operation of a fixing apparatus of Embodiment 2 according to present invention.

At first, power switch of the image forming apparatus is turned on. Then, the temperature levelling roller 17 of a levelling means is separated from the fixing belt 12. Succeedingly, print start request to start printing to the print media 16, is performed. Then, it is judged whether warming up (heating process) is needed or not. In case that warming up is needed, the temperature levelling roller 17 is separated from the fixing belt 12. In case that warming up is not needed, position of the temperature levelling roller 17 is left in present situation.

Succeedingly, the process waits until warming up of fixing belt 12 is completed. If warming up is completed, it is judged whether the print media 16 is a sheet with narrow width or not. And, in case that it is a sheet with narrow width, the temperature levelling roller 17 is contacted with the fixing belt 12. Moreover, in case that it is not a sheet with narrow width, the temperature levelling roller 17 is separated from the fixing belt 12.

Succeedingly, printing to the print media 16 is performed. And, when printing is finished, in case that printing is performed succeedingly to other print media 16, the operation after print start request mentioned above is repeatedly performed. In this case, the temperature levelling roller 17 waits being left at present position same as position when the last printing is performed.

Subsequently referred to is the flow chart.

At step S11, power switch is turned on.

At step S12, the temperature levelling roller 17 is separated from the fixing belt 12.

At step S13, print start request is received.

At step S14, it is judged whether warming up is needed or not. In case that warming up is needed, the process proceeds to step S15. In case that warming up is not needed, the process proceeds to step S17.

At step S15, the temperature levelling roller 17 is separated from the fixing belt 12.

At step S16, it is judged whether warming up is completed or not. In case that warming up is completed, the process proceeds to step S17. In case that warming up is not completed, the process waits.

At step S17, it is judged whether print media 16 is a sheet with narrow width or not. In case that print media 16 is a sheet with narrow width, the process proceeds to step S18. In case that print media 16 is not a sheet with narrow width, the process proceeds to step S19.

At step S18, the temperature levelling roller 17 is contacted with the fixing belt 12.

At step S19, the temperature levelling roller 17 is separated from the fixing belt 12.

At step S20, printing is performed.

At step S21, it is judged whether printing is ended or not. In case that printing is ended, the process ends. In case that printing is not ended, the process proceeds to step S13.

<Effects>

As mentioned above, in Embodiment 2, it is possible either to separate the temperature levelling roller 17 from the fixing belt 12 or to contact the temperature levelling roller 17 with the fixing belt 12. Therefore, when width of the print media 16 passing through the fixing nip is less than a prescribed size, such as an occasion when printing to print media 16 with narrow width is performed, temperature of the fixing belt 12 is levelled by contacting the temperature levelling roller 17 with the fixing belt 12, because irregularity of temperature in the fixing belt 12 is likely to occur.

Moreover, like warming up, in heating process which needs to increase temperature of the fixing belt 12, the temperature levelling roller 17 is separated from the fixing belt 12 until temperature of the fixing belt 12 reaches to a prescribed temperature. In this occasion, heat energy held in the fixing belt 12 is prevented from getting out into the air through the temperature levelling roller 17 having good heat conductivity, by separating the temperature levelling roller 17 from the fixing belt 12. Therefore, temperature of the fixing belt 12 rises up quickly to an object temperature.

Further, following effect is obtained. There is an occasion for a fixing apparatus 10 to cool down the fixing belt 12. In order to fix properly, temperature for fixing is set high for thick sheet, while it is set low for thin sheet. Therefore, in occasion when printing to a thin sheet is performed after printing to thick sheet, the fixing apparatus 10 waits for the fixing belt 12 to decrease its temperature, so as to start printing. In this occasion, the fixing temperature decreases quickly with an effect of radiating heat through the temperature levelling roller 17. That is, in occasion of cooling down process of fixing apparatus 10 mentioned above, the temperature levelling roller 17 is contacted with the fixing belt 12. Thereby, heat energy held in the fixing belt 12 gets out into the air through the temperature levelling roller 17. And, throughput of the fixing apparatus increases.

Embodiment 3

<Configuration>

Subsequently described is Embodiment 3 of present invention. Incidentally, elements in Embodiment 3, which have configuration same as corresponding elements in Embodiment 1 and 2, are designated with the same symbols. Thereby, same description duplicating is omitted. Moreover, same operation and same effect is omitted.

Figure 10:
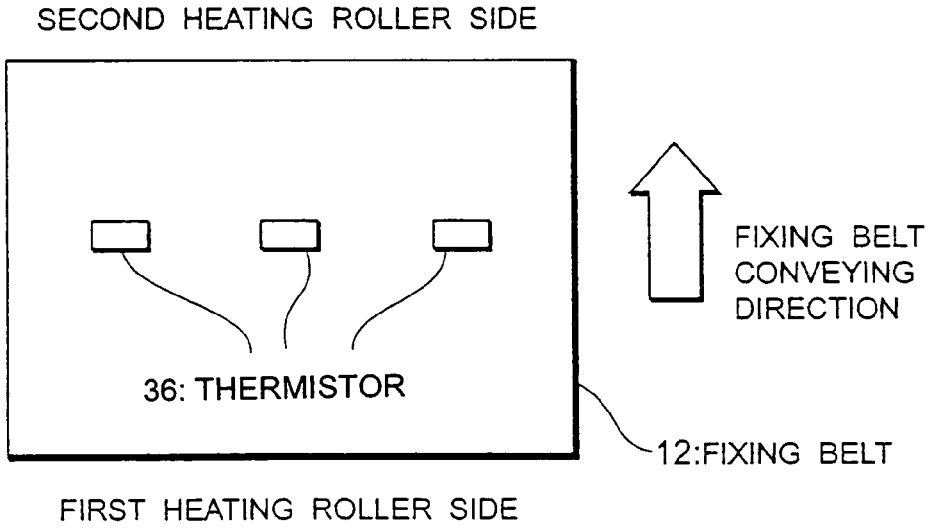
FIG. 10 is a plan view showing configuration of mounting position of temperature detecting devices of Embodiment 3 according to present invention.

FIG. 10 is a plan view showing configuration of mounting position of temperature detecting devices of Embodiment 3 according to present invention.

Meanwhile, in Embodiment 2 mentioned above, a temperature detecting sensor is installed only at central portion in direction of width of fixing belt 12. Therefore, state of temperature at both end portions in direction of width of fixing belt 12 is not detected. And, there is a case that print quality decreases, in an occasion when temperature at both end portions in direction of width of fixing belt 12 is increased. Therefore, in Embodiment 2, temperature detecting sensors are installed at both end portions in direction of width of fixing belt 12 as well as central portion.

In FIG. 10, temperature detecting sensors as temperature detecting means comprising thermistor 36, are installed outside of the fixing belt 12 (c.f. FIGS. 1A and 1B) in a course of conveying the fixing belt 12 from first heating roller 11 to second heating roller 13. Said temperature detecting sensors 36 are installed at central portion and at both end portions in direction of width of fixing belt 12, as arrayed in a line. Here, positions of temperature detecting sensors 36 installed at both end portions, correspond to both ends of a maximum width able to print.

And, temperature of the central portion and both end portions of fixing belt 12 detected by said temperature detecting sensor 36, is sent from fixing temperature detecting portion 25 to fixing control section 23-2. The fixing control section 23-2 calculates difference of temperature between central portion and both end portions of fixing belt 12. And, it sends control signals to the temperature levelling roller driving section 26 according to result of calculating difference of temperature. In this occasion, the temperature levelling roller driving section 26 contacts the temperature levelling roller 17 with the fixing belt 12, if difference of temperature between central portion and both end portions of fixing belt 12 is more than a prescribed temperature of 10 degrees Celsius. Moreover, the temperature levelling roller driving section 26 separates the temperature levelling roller 17 from the fixing belt 12, if difference of temperature between central portion and both end portions of fixing belt 12 becomes less than a prescribed temperature of 10 degrees Celsius.

In Embodiment 3, said temperature detecting sensors 36 are installed at the three portions, that is, central portion and both end portions of the fixing belt 12. However, positions of said temperature detecting sensors 36 are selected in any other ways. For example, they can be central portion and right end portion of the fixing belt 12. Or, instead, they can be central portion and left end portion. Moreover, in Embodiment 3, positions of said temperature detecting sensors 36 installed at both end portions are set to positions corresponding to maximum width able to print. However, not limited to this, they can be positions outside of maximum width able to print. In this occasion, the difference of temperature between central portion and both end portions of fixing belt 12 as a prescribed temperature to decide whether the temperature levelling roller 17 to separate or contact with the fixing belt 12 is preferably set to a value more than 10 degrees Celsius.

<Operation>

Subsequently described is operation of the fixing apparatus 10 of Embodiment 3.

Figure 11:
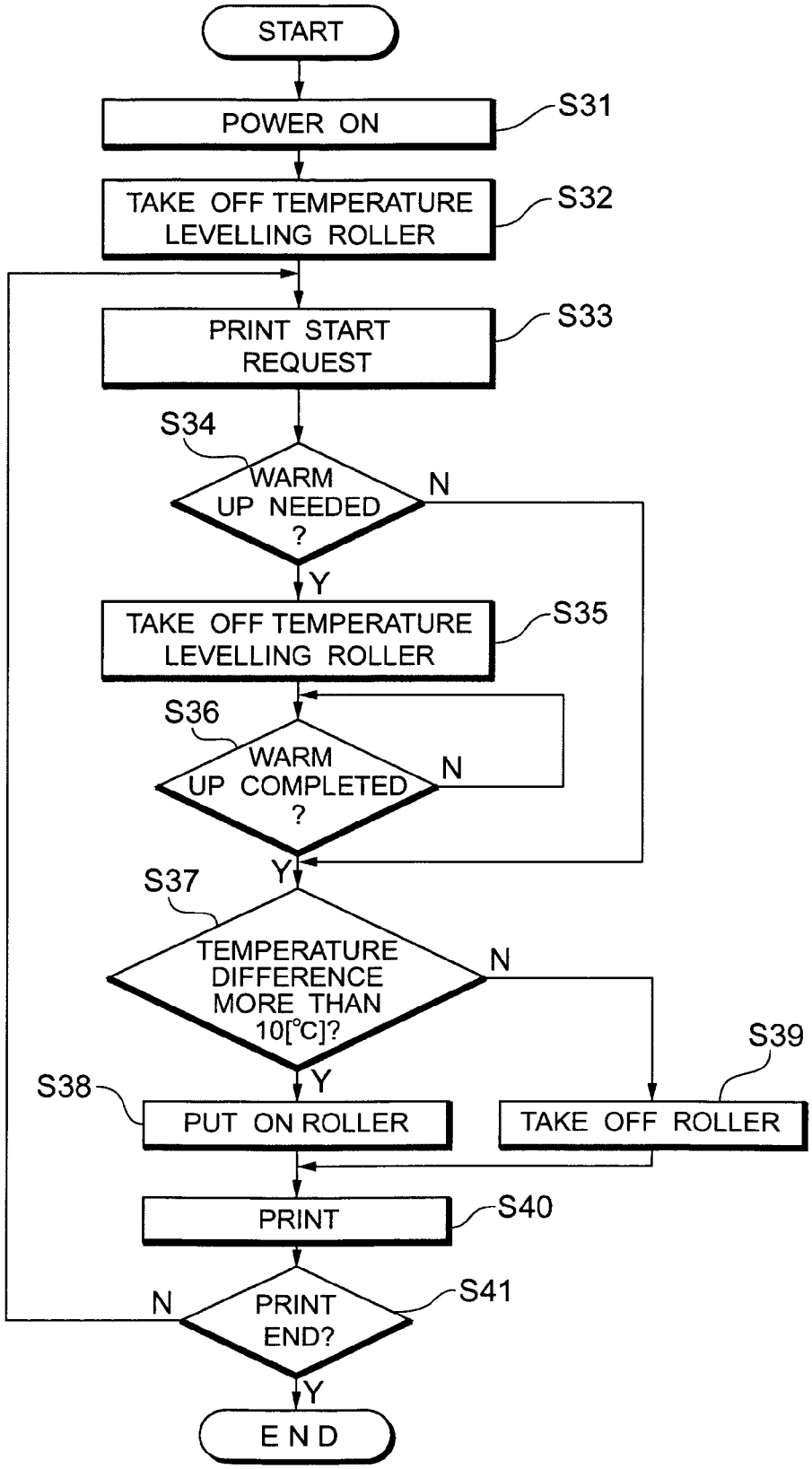
FIG. 11 is a flow chart showing operation of a fixing apparatus of Embodiment 3 according to present invention.

FIG. 11 is a flow chart showing operation of a fixing apparatus of Embodiment 3 according to present invention;

At first, power switch of the image forming apparatus is turned on. Then, the temperature levelling roller 17 of a levelling means is separated from the fixing belt 12. Succeedingly, print start request to start printing to the print media 16, is performed. Then, it is judged whether warming up is needed or not. In case that warming up is needed, the temperature levelling roller 17 is separated from the fixing belt 12. In case that warming up is not needed, position of the temperature levelling roller 17 is left in present situation.

Succeedingly, the process waits until warming up of fixing belt 12 is completed. If warming up is completed, it is judged whether difference of temperature between central portion and both end portions of fixing belt 12 is more than 10 degrees Celsius or not. And, in case that it is more than 10 degrees Celsius, the temperature levelling roller 17 is contacted with the fixing belt 12. Moreover, in case that it is less than 10 degrees Celsius, the temperature levelling roller 17 is separated from the fixing belt 12.

Succeedingly, printing to the print media 16 is performed. And, when printing is finished, in case that printing is performed succeedingly to other print media 16, the operation after print start request mentioned above is repeatedly performed. In this case, the temperature levelling roller 17 waits being left at present position same as position when the last printing is performed.

Subsequently referred to is the flow chart.

At step S31, power switch is turned on.

At step S32, the temperature levelling roller 17 is separated from the fixing belt 12.

At step S33, print start request is received.

At step S34, it is judged whether warming up is needed or not. In case that warming up is needed, the process proceeds to step S35. In case that warming up is not needed, the process proceeds to step S37.

At step S35, the temperature levelling roller 17 is separated from the fixing belt 12.

At step S36, it is judged whether warming up is completed or not. In case that warming up is completed, the process proceeds to step S37. In case that warming up is not completed, the process waits.

At step S37, it is judged whether difference of temperature between central portion and both end portions of fixing belt 12 is more than 10 degrees Celsius or not. In case that it is more than 10 degrees Celsius, the process proceeds to step S38. In case that it is less than 10 degrees Celsius, the process proceeds to step S39.

At step S38, the temperature levelling roller 17 is contacted with the fixing belt 12.

At step S39, the temperature levelling roller 17 is separated from the fixing belt 12.

At step S40, printing is performed.

At step S41, it is judged whether printing is ended or not. In case that printing is ended, the process ends. In case that printing is not ended, the process proceeds to step S13.

<Effects>

As mentioned above, in Embodiment 3, the temperature detecting sensors 36 are installed at central portion and at both end portions in direction of width of the fixing belt 12. Therefore, difference of temperature between central portion and both end portions of the fixing belt 12 can be detected at all times. And, when difference of temperature between central portion and both end portions of the fixing belt 12 becomes more than a prescribed value, the temperature levelling roller 17 is contacted with the fixing belt 12.

That is, in case that difference of temperature between central portion and right end portion of the fixing belt 12, or difference of temperature between central portion and left end portion of the fixing belt 12 is more than a prescribed value, the temperature levelling roller 17 is contacted with the fixing belt 12. Moreover, in case that difference of temperature between central portion and right end portion of the fixing belt 12, or difference of temperature between central portion and left end portion of the fixing belt 12 is less than a prescribed value, the temperature levelling roller 17 is separated from the fixing belt 12. Incidentally, in case that difference of temperature between central portion and right end portion of the fixing belt 12, or difference of temperature between central portion and left end portion of the fixing belt 12 is less than a prescribed value, the temperature levelling roller 17 can be separated from the fixing belt 12.

Thereby, without specifying size of print media 16, surface temperature of the fixing roller 12 is levelled, if necessary. Therefore, a stable print quality can be kept.

OTHER EMBODIMENTS

Incidentally, the present invention is not limited to Embodiments mentioned above. It can be modified within the scope of the invention. That is, any modified Embodiment is not excluded from the scope of the present invention.

What is claimed is:

1. A fixing apparatus for an image forming apparatus, comprising:

a first supporting member, a second supporting member, a fixing belt installed around the first supporting member and around the second supporting member, and a temperature levelling portion made of heat conducting material and positioned to contact said fixing belt, wherein:

one of said first supporting member and said second supporting member is provided with a heater to heat one of said first and second supporting members so as to heat said fixing belt for fixing toner on print media in passing contact with said fixing belt, and said temperature levelling portion is positioned downstream of said heater and upstream of a region where said print media contact said fixing belt, between said heater and said region where said print media contact said fixing belt, in a direction of rotation of said fixing belt and levels temperature in a width direction of said fixing belt after said fixing belt is heated and before said print media contact said fixing belt.

2. A fixing apparatus according to claim 1 further comprising:

a moving device to move said temperature levelling portion away from said belt and to said belt.

3. A fixing apparatus according to claim 2 further comprising:

a media width detecting section to detect media width by obtaining media data of said print media, and a moving device operating section to operate said moving device based on media width detected by said media width detecting section.

4. A fixing apparatus according to claim 3:

wherein said moving device operating section operates said temperature levelling portion to be contacted with said belt, in a case that media width detected is less than a prescribed size.

5. A fixing apparatus according to claim 2 further comprising:

a temperature detecting section to detect a temperature of said fixing belt, and, a moving device operating section to operate said moving device based on said temperature detected by said temperature detecting section.

6. A fixing apparatus according to claim 5:

wherein said moving device operating section operates said temperature levelling portion to be away from said belt, until said temperature detected reaches a prescribed temperature.

7. A fixing apparatus according to claim 2 further comprising:

temperature detecting devices positioned substantially at a central portion and at an end portion in said width direction of said fixing belt, a control section to detect temperature difference between temperatures of the central portion and the end portion of a width of said belt detected by said temperature detecting devices, and a moving device operation section to operate said moving device, based on said temperatures detected by said temperature detecting devices.

8. A fixing apparatus according to claim 7:

wherein said moving device operating section operates said temperature levelling portion to be contacted with said belt, in a case that said temperature difference is more than a prescribed value.

9. A fixing apparatus according to claim 7:

wherein said moving device operating section operates said temperature levelling portion to be taken off said belt, in a case that said temperature difference is less that a prescribed value.

10. A fixing apparatus according to claim 2 further comprising:

a temperature detecting device to detect a temperature of said fixing belt, a control section to control supply of electric power, based on said temperature detected by said temperature detecting device, and a moving device operating section to operate said moving device; wherein said moving device operating section operates said temperature levelling portion to be contacted with said belt, when said temperature of said fixing belt is decreased by said control section.

11. A fixing apparatus according to claim 1 further comprising:

temperature detecting devices positioned substantially at a central portion and at an end portion in said width direction of said fixing belt, and a control section to control a supply of electric power based on temperatures detected by said temperature detecting devices.

12. A fixing apparatus according to claim 1 further comprising:

temperature detecting devices positioned substantially at opposing end portions in said width direction of said fixing belt, and a control section to control a supply of electric power, based on temperatures detected by said temperature detecting devices.

13. A fixing apparatus according to claim 11:

wherein said temperature detecting devices are positioned at an inner surface of said belt.

14. A fixing apparatus according to claim 11:

wherein said temperature detecting devices are positioned at an outer surface of said belt.

15. A fixing apparatus according to claim 1:

where said temperature levelling portion is positioned to roll on surface of said belt.

16. A fixing apparatus according to claim 1, wherein:

said temperature levelling portion is positioned behind said second supporting member and in front of said first supporting member in a direction of rotation of said fixing belt.

17. A fixing apparatus according to claim 1, wherein:

said second supporting member is provided with said heater to heat said fixing belt.

18. A fixing apparatus according to claim 1, wherein:

said first supporting member is provided with said heater to heat said fixing belt.

19. A fixing apparatus according to claim 1, further comprising:

a pad abutting an inner surface of said fixing belt adjacent said pressuring portion, so as to extend a nip between said fixing belt and said pressuring portion.

20. A fixing apparatus according to claim 1, further comprising:

a pressuring portion positioned to face said second supporting member, wherein:

both of said first supporting member and said second supporting member are provided with heaters to heat said first and second supporting members so as to heat said fixing belt for fixing toner on said print media in passing contact with said fixing belt, and said temperature levelling portion is positioned downstream of said second supporting member and upstream of said first supporting member in a direction of rotation of said fixing belt and levels temperature in a width direction of said fixing belt after said fixing belt is heated through said second supporting member and before said fixing belt is heated through said first supporting member.

* * * * *